United States Patent [19]

Munz

[11] Patent Number: 4,735,292

[45] Date of Patent: Apr. 5, 1988

[54] HYDRAULICALLY OPERATED ELEVATOR DOOR MECHANISM

[76] Inventor: William E. Munz, 1605 Ridgely St., Baltimore, Md. 21230

[21] Appl. No.: 6,090

[22] Filed: Jan. 23, 1987

Related U.S. Application Data

[63] Continuation of Ser. No. 781,900, Sep. 30, 1985, abandoned.

[51] Int. Cl.[4] ..... B66B 13/00

[52] U.S. Cl. ..... 187/56; 49/360; 60/476

[58] Field of Search ..... 187/56, 52 R, 51; 49/360; 60/473, 476

[56] References Cited

U.S. PATENT DOCUMENTS 2,378,409 6/1945 Joy ..... 60/476
2,480,527 8/1949 Wachter et al. ..... 49/360
3,327,428 6/1967 Horton et al. ..... 49/360

FOREIGN PATENT DOCUMENTS 89252 8/1922 Austria ..... 60/476
556487 6/1972 Canada ..... 60/476

*Primary Examiner*—Joseph J. Rolla
*Assistant Examiner*—Kenneth Noland
*Attorney, Agent, or Firm*—Walter G. Finch

[57] ABSTRACT

A hydraulically operated elevator door mechanism includes a motor-driven shaft connected to rotate gears within a fluid reservoir. Fluid is "pumped" as the gears rotate, to one side of a piston, propelling the piston. The piston is connected to two pulleys over which a cable length is attached to the elevator door. Piston movement causes the pulleys to effectively shorten the length of cable between the pulley and door, which in turn, causes the door to slide.

10 Claims, 3 Drawing Sheets

HYDRAULICALLY OPERATED ELEVATOR DOOR MECHANISM

This patent application is a continuation of my U.S. patent application, Ser. No. 781,900 filed Sept. 30, 1985 and now abandoned, for "Hydraulically Operated Elevator Door Mechanism".

The priot Art:

| Patents | Inventor |
|---|---|
| 1,530,964 | |
| 1,574,717 | |
| 1,632,506 | |
| 1,751,058 | |
| 1,845,904 | |
| 1,950,150 | |
| 2,579,017 | |
| 3,012,636 | |
| 3,738,454 | |
| 3,194,345 | |
| 3,231,048 | |
| 3,370,677 | |
| 3,535,837 | |
| 3,598,202 | |
| 3,605,952 | |
| 3,702,645 | |
| 3,739,009 | |
| 1,927,580 | Wisner |
| 2,378,409 | Joy |
| 2,480,527 | Wachter |
| 3,327,428 | Horton et al |
| 89,252 | Siemens (Austrian) |
| 556,487 | Hobrough (Canada) |
| 1,012,707 | Nibaud (France) |

BACKGROUND OF THE INVENTION

This invention relates to elevator systems, and in particular to the opening and closing of elevator cab doors using a hydraulic drive unit to move the doors open and closed.

In a typical automatic elevation system, there is an automatic drive unit mounted on the cab that opens and closes the cab door. Typically, such system includes a DC motor with an assembly of various mechanical cams, used to operate electrical "slow-down" units. These systems, with many moving parts, are subject to frequent malfunction and are not easily or efficiently repaired.

SUMMARY OF THE INVENTION

A hydraulically operated elevator door mechanism is proposed having a housing and motor which drives a shaft connected to a first spur gear. A second spur gear meshes with the first spur gear to be turned thereby, the two spar gears situated in a housing chamber and acting as a pump, driving oil through the chamber in a direction which depends on rotation of the shaft. At both ends of the chamber are orifices in the housing, fluidly connecting a cylinder chamber in which a piston is located. Thus, rotation of the shaft in one direction cause oil to be pumpted into one side of the cylinder chamber, increasing pressure on one side of the piston. A corresponding decrease in pressure occurs on the opposite side of the piston, the pressure difference over the piston propelling the piston toward the pressure side. Valve pins are used to control oil flow through the orifices, and thus control piston speed relative to the stationary housing. A cable connects the housing over two pulleys to an elevator door which moves in response to the piston movement.

An object of this invention is to provide a means of moving the door using a reversible drive motor, a reversible pump, a movable piston and a 2:1 linkage system.

Another object of the invention is to provide a door operating mechanism that have few moving parts, is quickly and efficiently adjusted, and is easily installed.

DETAILED DESCRIPTION OF THE INVENTION

Figure 1:
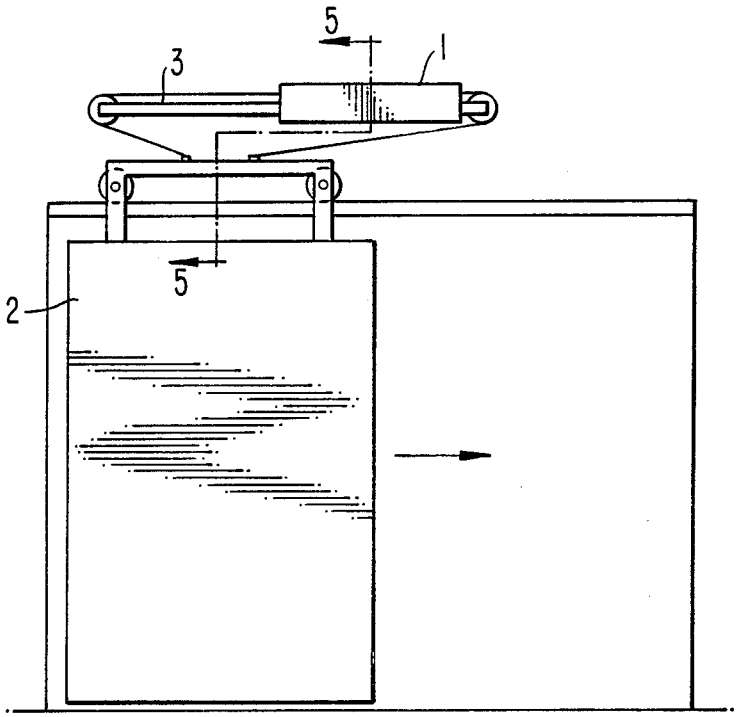
FIG. 1 shows a hydraulic drive unit mounted on an elevator car top with a drive piston extended, and the door open.

FIG. 1 shows a housing structure 1 mountcd to a wall surface, the remaining elements of the hydraulically operated door mechanism having been actuated to drive the door 2 left. The shaft like structure 3 comprises the rail which is guided through the housing structure 1 to pull the door 2 in the same direction as the rail 3 moves.

Figure 2:
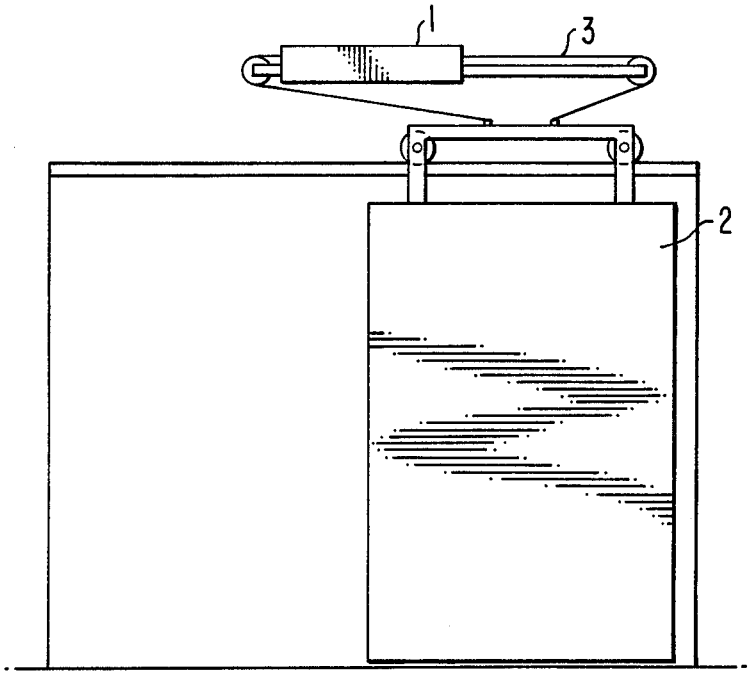
FIG. 2 shows a hydraulic drive unit mounted on an elevator car top with a drive piston extended opposite that of FIG. 1, and the door closed.

FIG. 2 shows the apparatus of the invention, however operated such that the door 2 is positioned to the right. Here, the rail 3 is shown after sliding through the housing structure 1. It is evident that the housing structure 1 is stationary with respect to the sliding door 2 and rail 3, but is merely positioned as such for purposes of illustration.

Figure 3:
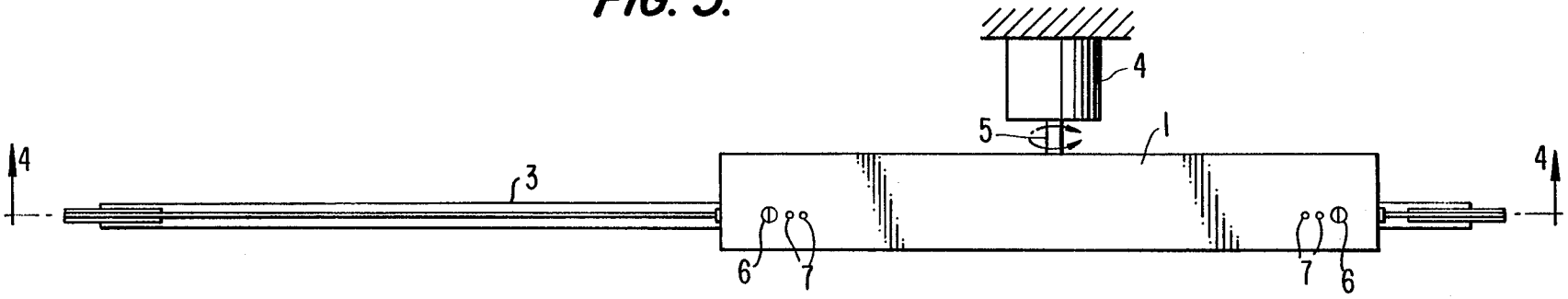
FIG. 3 reveals a top view of the present invention.

FIG. 3 shows a top view of a hydraulically operated elevator door mechanism, in accordance with the present invention. In addition to the elements of FIGS. 1 and 2, a driving means or motor 4 is shown attached to a wall surface, and having a shaft 5 connected to drive a gear-like means (not shown) located within the housing structure 1. The details of operation of the present invention are better understood with respect to FIGS. 4 and 5 below. Valve pins 6 and 7 may be adjusted from the top side of the housing structure 1, for controlling the flow of fluid (discussed below) within the housing structure 1, such that the open and closing speed of the door may be regulated.

Figure 4:
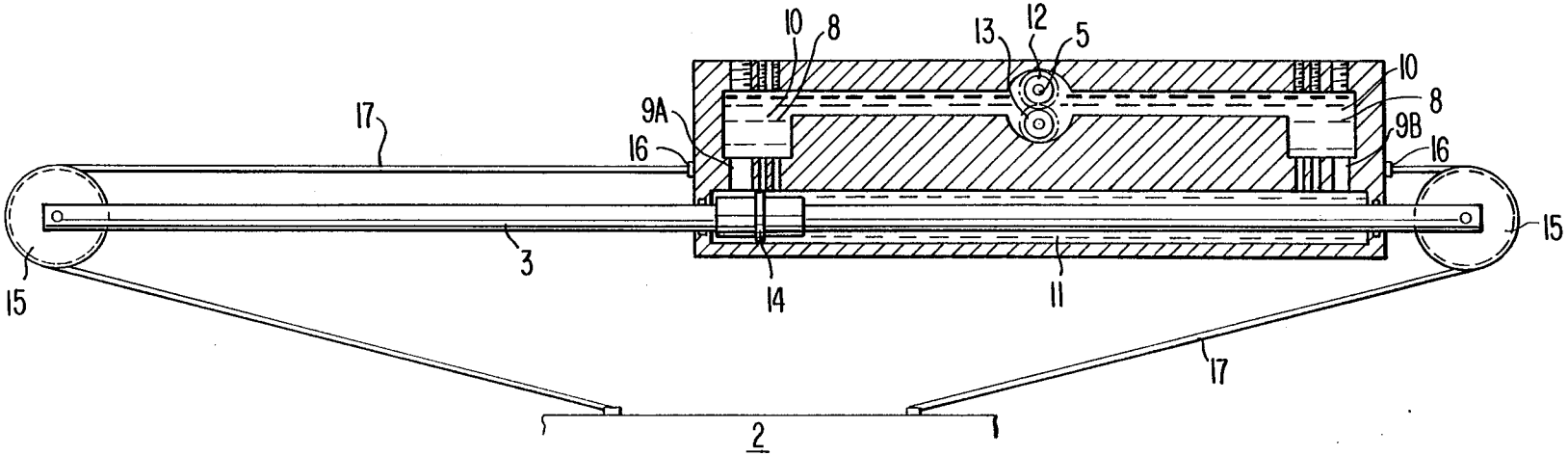
FIG. 4 portrays a sectional side view of the present invention.

FIG. 4 provides a side, sectional view of the mechanism, taken along line 4—4 of FIG. 3. Within the housing structure 1 is a means for containing a fluid 8, comprising orifices 9A and 9B which fluidly connect a reservoir chamber 10 to a cylinder chamber 11. As is evident, the orifices 9A and 9B, the reservoir chamber 10 and the cylinder chamber 11 form a closed loop in which the oil 8 or other hydraulic fluid flows. To the shaft 5 is mounted a spur gear 12 which is rotated in response to any turning of the shaft 5 by the motor 4 (see FIG. 3). A second spur gear 13 is meshed with the spur gear 12 and is driven thereby. Thus, if the shaft 5 is actuated in the clockwise direction, so is the spur gear 12, while the spur gear 13 turns in the counter-clockwise direction. Attached to the rail 3 is a piston and piston ring 14 coaxial with the rail 3. The piston ring 14 divides the cylinder chamber 11 into two portions which vary in size depending upon the position of the piston ring 14. Attached to either end of the rail 3 are pulleys 15. Anchors 16, at the housing structure 1, secure two lengths of cable 17 which extend over the respective pulleys 15 and are connected to the door 2.

The operation of the present invention is must easily seen with respect to FIG. 4. Actuation of the motor 4 may turn the shaft 5, and thus the spur gear, in a clockwise direction. Accordingly, the meshed spur gear 13 rotates counter-clockwise, the two spur gears 12, 13 driving fluid left as viewed in FIG. 4. Fluid 8 so forced, flows from the reservoir chamber 10 through the orifice 9A and into the left portion of the cylinder chamber 11. Thus, a high pressure is realized within the cylinder chamber to the left of the piston ring 14, and owing to the closed loop fluid path a corresponding low pressure is created in the cylinder chamber 11 portion which is right of the piston ring 14. The resultant differential pressure occurring across the piston ring 14 propels the piston right, towards the low-pressure side. The rail 3 being connected to the piston, also moves to the right carrying pulleys 15. Since the right cable length 17 is attached to the housing structure 1 at 16 and because the right pulley is moving right, the portion of the cable length 17 between the right pulley 15 and the door 2 "shortens", in a manner which causes the door 2 to slide right. In effect the cable pulls the door. Thus, for every inch of piston 14/rail 4 travel, the door travels two inches. It is readily apparent that turning the shaft 5 counter-clockwise will move the door left.

Also visible in FIG. 4 are threaded holes for reception of the valve pins 6 and 7. Turning of the valve pins 6, 7 into the threaded holes will close off any of the desired orifices 9A, 9B. Thus, the flow of fluid within the closed loop is regulated by adjusting the valve pins 6, 7 to an appropriate depth, which in turn regulates the speed at which the door opens and closes. Evident also, in the housing structure 1 where the rail 3 exits, are two sealing members which prevent leakage of the fluid 8 from the cylinder chamber 11.

Figure 5:
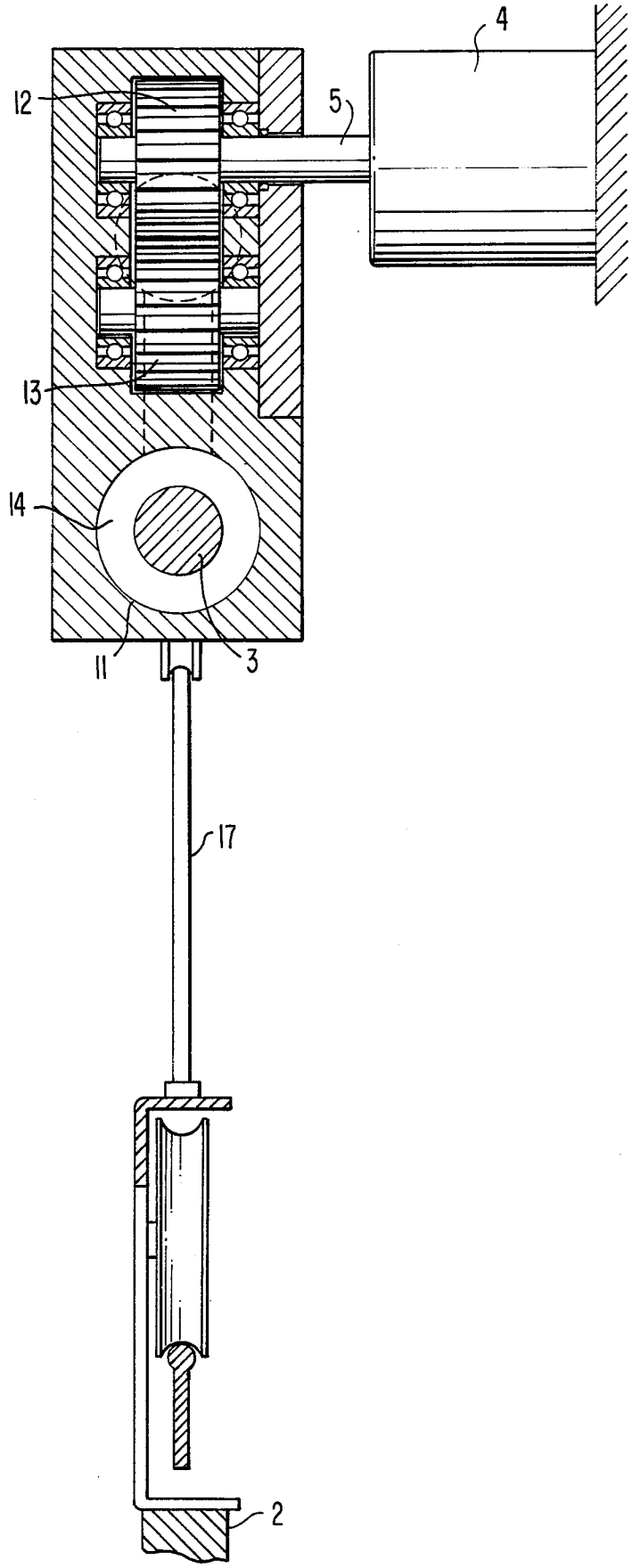
FIG. 5 presents a sectional end view of the present invention.

FIG. 5 shows a sectional end view of the invention, wherein the piston ring 14 is shown closing off the cylinder chamber 11 into a front portion (the rear portion is not visible). Here, the coaxially relationship of the piston ring 14 and rail 3 are easily seen. The shaft 5 is directly coupled to the spur gear 12 to spin upon its associated bearing. The meshed spur gear 13 rotates freely upon its associated bearing, but being meshed with the spur gear 12 is driven in a direction opposite that of the rotating spur gear 12.

Modifications to the present invention are apparent to those skilled in the art, which do not depart from the spirit of the present invention, the scope being defined by the appended claims.

What is claimed is:

1. A hydraulically operated mechanism for operating a door device relative to a surface, comprising, a structural means including a housing connected to a surface; a door device arranged to slide relative to said structural means; a cabling means connected between and said structural means for sliding said door device said door device relative to said structural means; a pulley means over which said cabling means passes for connecting said door device and said structural means; a containing means completely contained within said housing including a reservoir chamber and a cylinder chamber fluidly connected to said reservoir chamber within said housing in said structural means for containing a fluid within said reservoir chamber, said containing means also including an orifice means fluidly connecting said reservoir chamber to said cylinder chamber, with said orifice means, said reservoir chamber and said cylinder chamber forming a closed loop in which said fluid is contained; a guiding means passing through said containing means and arranged so as to slide through said structural means; a piston means connected to said guiding means with said containing means for fluidly blocking a variable portion of said containing means and for sliding relative to said structural means; said piston means including a piston ring surrounding a piston which is mounted coaxially with a shaft-like structure and being located in said cylinder chamber and fluidly dividing said cylinder chamber into two variable portions; a fluid forcing means connected to said structural means for forcing said fluid against said piston means to cause said piston and guiding means to slide, said fluid forcing means including a gear-like mechanism positioned within said housing and a driving means connected to said gear-like mechanism for rotating said gear-like mechanism, and a controlling means connected to said housing for closing and opening said orifice means, and thus regulating said fluid flow in the closed circuit, said controlling means includes pin-valves connected to said orifice means which are operated to open and close said orifice means.

2. A hydraulically operated mechanism for operating a door relative to said surface as recited in claim 1, said guiding means comprising a shaft-like structure passing through said cylinder chamber and exiting said housing, and a pair of sealing members at either end of said housing, sealing said fluid within said cylinder chamber where said shaft-like structure exits said housing.

3. A hydraulically operated mechanism for operating a door relative to said surface as recited in claim 2, said gear-like means comprising a first spur gear, said driving means comprising a motor, said mechanism including a shaft connecting said motor to said first spur gear.

4. A hydraulically operated mechanism for operating a door relative to said surface as recited in claim 3, the fluid contained within said closed loop comprising a hydraulic fluid.

5. A hydraulically operated mechanism for operating a door relative to said surface as recited in claim 4, including a second spur gear meshed with said first spur gear and driven thereby.

6. A hydraulically operated mechanism for operating said door relative to said surface as recited in claim 1, said fluid forcing means comprising a gear-like means and a driving means connected to said gear-like means for rotating said gear-like means.

7. A hydraulically operated mechanism for operating said door relative to said surface as recited in claim 6, said guiding means comprising a shaft-like structure passing through said cylinder chamber and exiting said housing, and a pair of sealing members at either end of said housing for sealing said fluid within said cylinder chamber where said shaft-like structure exits said housing.

8. A hydraulically operated mechanism for operating said door relative to said surface as recited in claim 7, said gear-like means comprises a first spur gear, said driving means comprises a motor and a shaft connecting said motor to said first spur gear.

9. A hydraulically operated mechanism for operating said door relative to said surface as recited in claim 8, with said fluid contained within said closed loop comprises a hydraulic fluid.

10. A hydraulically operated mechanism for operating said door relative to said surface as recited in claim 9, including a second spur gear meshing with said first spur gear and driven thereby.

* * * * *